US006027090A

United States Patent [19]

Liu

[11] Patent Number: 6,027,090

[45] Date of Patent: Feb. 22, 2000

[54] SUPPORTING ASSEMBLY FOR ARTICLES

[76] Inventor: Clement Liu, No. 56-3, Kan Tung, Kan Tung, Kuei Jen Hsiang, Tainan Hsien, Taiwan

[21] Appl. No.: 09/190,878

[22] Filed: Nov. 12, 1998

[51] Int. Cl.[7] ..... E04G 3/00

[52] U.S. Cl. ..... 248/281.11; 248/278.1; 248/286.1; 248/918

[58] Field of Search ..... 248/281.11, 918, 248/18, 118.3, 274.1, 276.1, 278.1, 286.1, 279.1, 284.1, 280.11, 292.13, 285.1; 108/140, 138

[56] References Cited

U.S. PATENT DOCUMENTS

| | | | |
|---|---|---|---|
| D. 412,894 | 8/1999 | Little et al. | D14/114 |
| 4,616,798 | 10/1986 | Smeenge et al. | 248/281.1 |
| 4,625,657 | 12/1986 | Little et al. | 108/93 |
| 4,706,919 | 11/1987 | Soberalski et al. | 248/281.1 |
| 5,037,054 | 8/1991 | McConnell | 248/284.1 |
| 5,145,136 | 9/1992 | McConnell | 248/284.1 |
| 5,257,767 | 11/1993 | McConnell | 248/284.1 |
| 5,762,399 | 6/1998 | Liu | 297/302.7 |
| 5,791,263 | 8/1998 | Watt et al. | 108/138 |
| 5,901,933 | 5/1999 | Lin | 248/285.1 |
| 5,924,666 | 7/1999 | Liu | 248/286.1 |

*Primary Examiner*—Anita King
*Attorney, Agent, or Firm*—Charles E Baxley, Esq.

[57] ABSTRACT

A supporting assembly includes a base plate attached to an underside of a desk, a carrier slidably attached to the base plate, and a mounting seat rotatably attached to the carrier to slide therewith. A connecting plate, a linking plate, and at least one linking piece are connected between the mounting seat and a supporting seat for supporting articles to securely retain the supporting seat in a desired level and inclination angle. A positioning device with a lever arm is provided to adjust the desired level and the inclination angle.

1 Claim, 8 Drawing Sheets

SUPPORTING ASSEMBLY FOR ARTICLES

BACKGROUND OF THE INVENTION

1. Field of the Invention

The present invention relates to a supporting assembly that is adjustably attached to a desk for supporting articles, e.g., a computer keyboard, a typewriter, books, etc.

2. Description of the Related Art

An office desk generally has a drawer slidably attached to an underside thereof for supporting a computer keyboard, a typewriter, books, or other articles. Nevertheless, the user may feel uncomfortable or even be subject to occupational harm after a long-term use if the drawer is not located at a desired height. The present invention is intended to provide an improved supporting assembly to solve this problem.

SUMMARY OF THE INVENTION

It is a primary object of the present invention to provide an improved supporting assembly that can be adjustably attached to a desk for supporting articles thereon.

A supporting assembly in accordance with the present invention comprises:

a base plate adapted to be secured to an object, a carrier slidably mounted to the base plate, a mounting seat secured to the carrier to slide therewith yet rotatable relative to the carrier, the mounting seat including a first axle and a second axle securely mounted thereon, a spring mounted around the first axle and including a first end attached to the mounting seat and a second end, a connecting plate including a first end pivotally connected to the mounting seat and a second end, a third axle being mounted to the second end of the connecting plate, the second end of the spring being attached to the connecting plate, a linking plate having a first end pivotally connected to the second axle and a second end, at least one linking piece having a first end pivotally connected to the first axle and a second end, a supporting seat including a top plate adapted to support an article thereon, the top plate including two parallel wings extended downwardly from an underside thereof each said wing including a first hole through which the third axle is extended and an arcuate slot located below said first hole, a positioning device including:

a rod extended through the arcuate slots of the wings, the rod including a first enlarged end having a second hole defined therein and a second threaded end, the rod being extended through the second end of the linking plate and the second end of said at least one linking piece, a lever arm including an operative first end for manual operation and a second end having an eccentric stub formed thereon, the eccentric stub having a threading provided on a distal end thereof the second end of the lever arm being extended through the second hole of the rod, and a nut being engaged with the threading, and a locking cap including a protrusion formed on an outer periphery thereof and received in the arcuate slot of the associated wing, the locking cap further including a receptacle defined therein for receiving the enlarged end of the rod, the locking cap further including a transverse hole through which the eccentric stub of the lever arm is extended.

When the lever arm is in a first position, the rod is retained in the arcuate slots and the top plate is retained in a level and an inclination angle relative to the mounting seat. When the lever arm is in a second position, the rod is slidable along the arcuate slots and thus allows adjustment of the level and inclination angle of the top plate.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
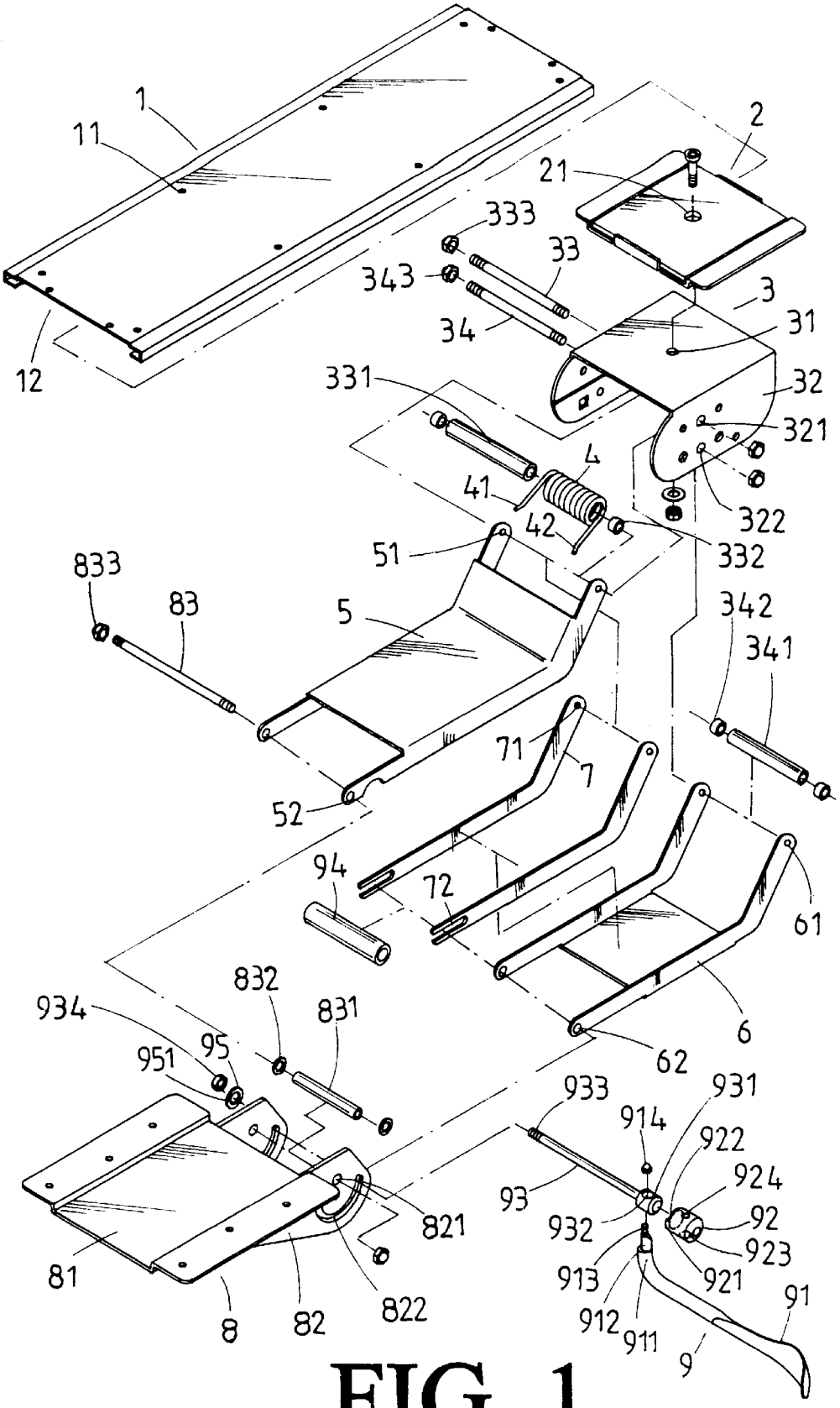
FIG. 1 is an exploded perspective view of a supporting assembly in accordance with the present invention.
Figure 2:
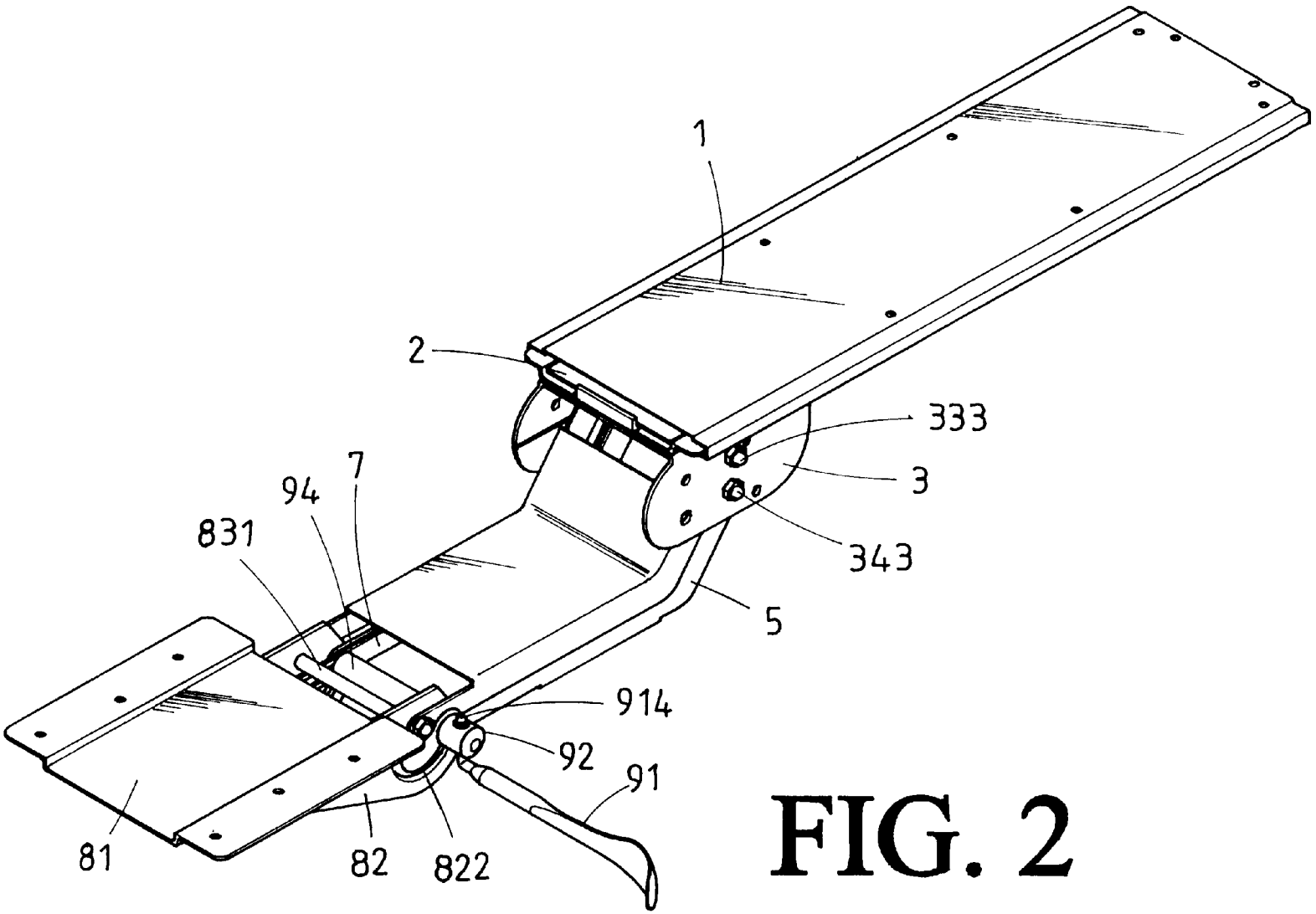
FIG. 2 is a perspective view of the supporting assembly.

Referring to the drawings and initially to FIGS. 1 and 2, a supporting assembly in accordance with the present invention generally includes a base plate 1, a carrier 2, a mounting seat 3, a spring 4, a connecting plate 5, a linking plate 6, two linking pieces 7, a supporting seat 8, and a positioning device 9. The base plate 1 includes a number of holes 11 so as to be secured to an appropriate location of an underside of an object, e.g., a desk (not shown) by screws (not shown) or the like. The base plate 1 includes a track 12 defined in an underside thereof. The carrier 2 is slidably received in the track 12, and the mounting seat 3 is rotatably secured to the carrier 2 by means of extending a screw (not labeled) through a hole 21 in the carrier 2 and a hole 31 in the mounting seat 3. Thus, the carrier 2 together with the mounting seat 3 is slidable along the track 12, while the mounting seat 3 is rotatable relative to the carrier 2.

Figure 7:
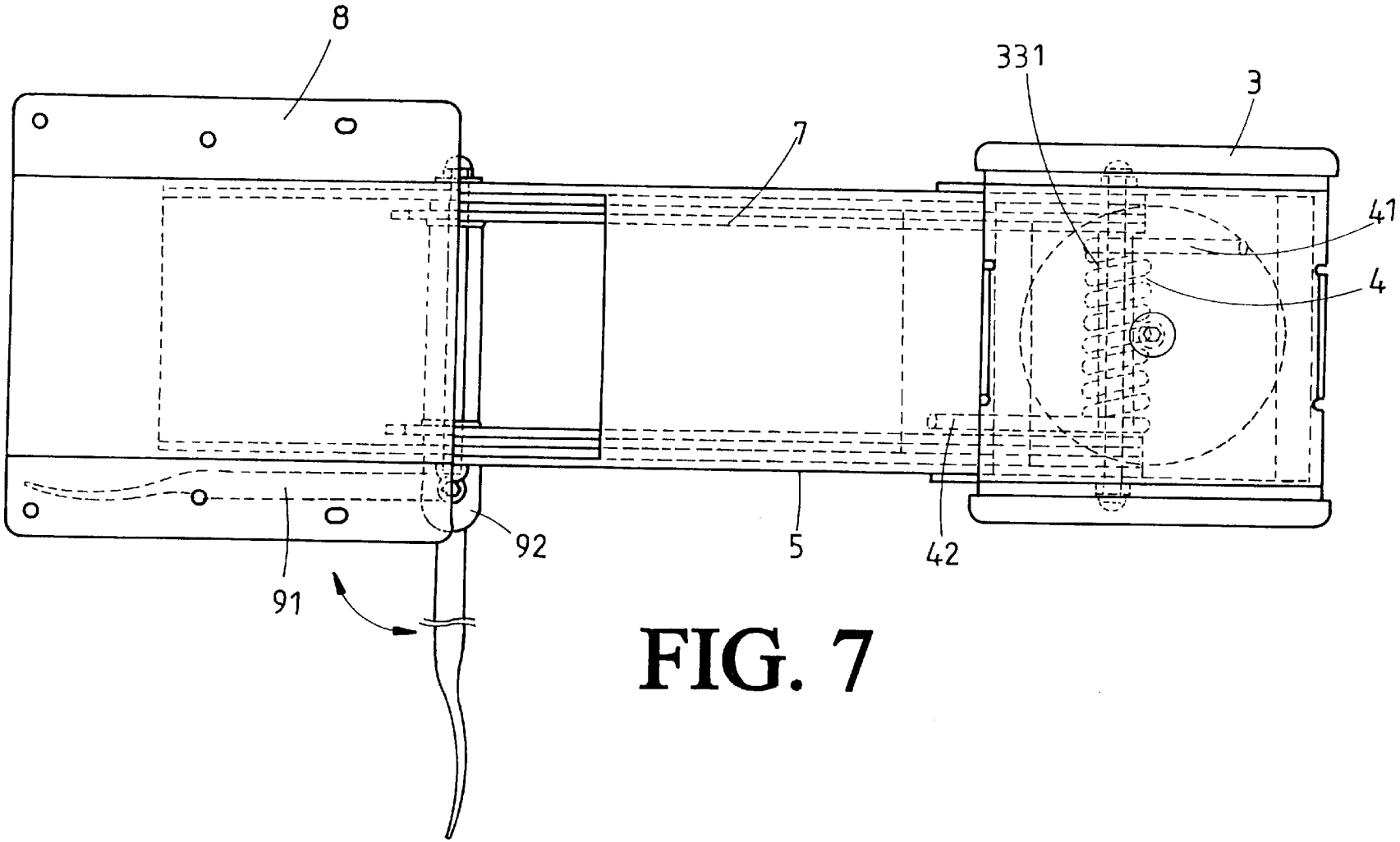
FIG. 7 is a top of the top view of the supporting assembly in FIG. 3.

The mounting seat 3 includes two lateral wings 32 having aligned holes 321 for securely receiving two ends of a first axle 33 and aligned holes 322 for securely receiving two ends of a second axle 34. A first tube 331 is mounted around the first axle 33, and ring washers 332 and nuts 333 are provided to both ends of the first axle 33. In addition, a second tube 341 is mounted around the second axle 34, and ring washers 342 and nuts 343 are provided to both ends of the second axle 34. This may provide a stable assembly. The spring 4 is mounted around the first tube 331 and includes a first end 41 attached to the mounting seat 3 and a second end 42 attached to the connecting plate 5 (FIG. 7).

The connecting plate 5 includes a first end pivotally connected to the first axle 33. In this embodiment, the first end of the connecting plate 5 includes two spaced prongs (not labeled) having aligned holes 51 defined therein through which the first axle 33 is extended. The second end of the connecting plate 5 also includes two spaced prongs (not labeled) having aligned holes 52 for securely receiving a third axle 83 which is secured in place by nuts 833. The third axle 83 may have a tube 831 mounted therearound, and washers 832 may be provided to provide a stable assembly.

Figure 3:
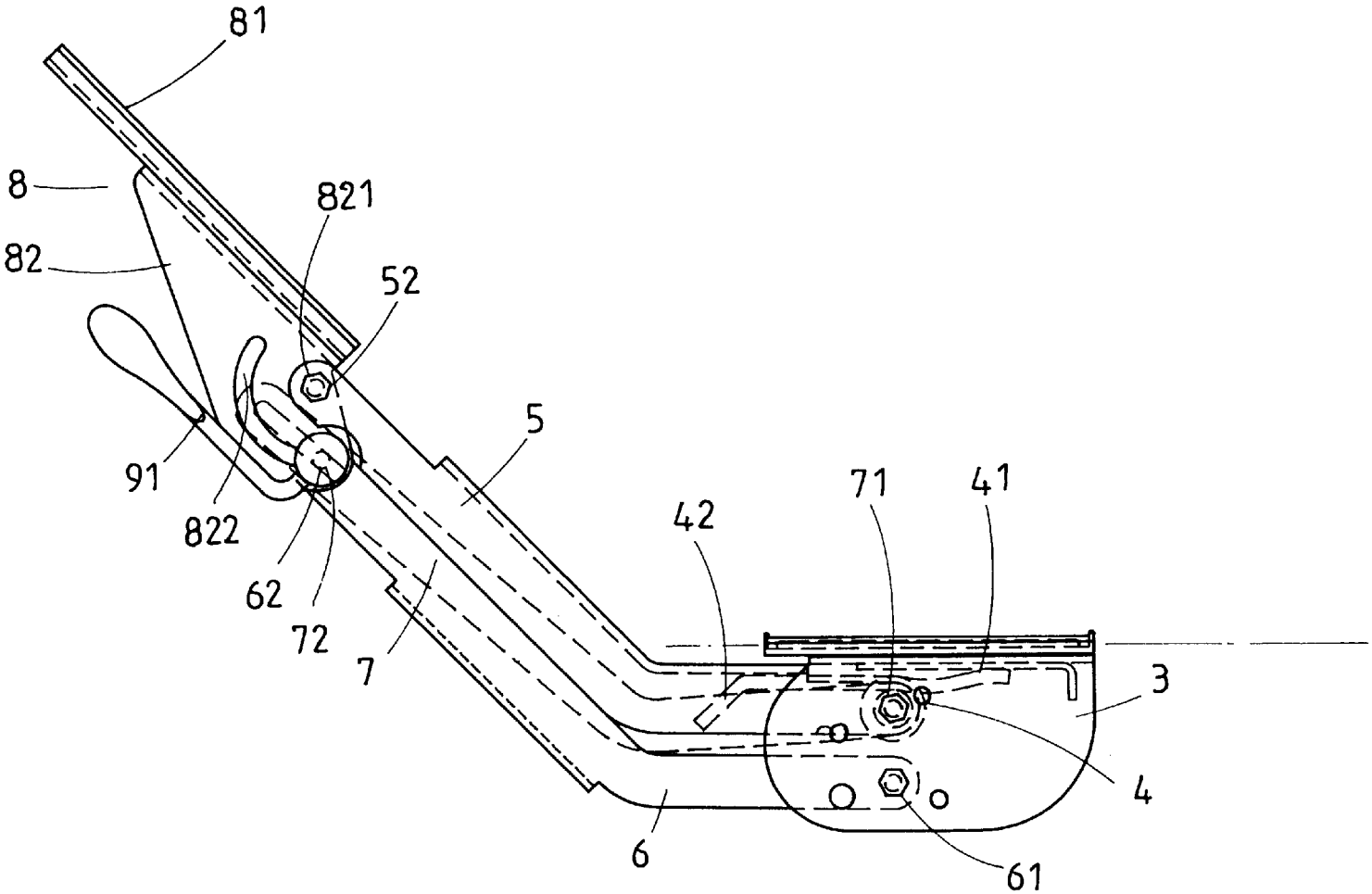
FIG. 3 is a side view of a portion of the supporting assembly.

The linking plate 6 includes a first end pivotally connected to the second axle 34 and a second end. In this embodiment, the first end of the connecting plate 6 includes two spaced prongs (not labeled) having aligned holes 61 defined therein through which the second axle 34 is extended. The second end of the connecting plate 6 also includes two spaced prongs (not labeled) having aligned holes 62, which will be described later. The linking plate 6 may be located below the connecting plate 5, as shown in FIG. 3.

The linking pieces 7 are mounted between two lateral sides of the linking plate 6. Each linking piece 7 includes a first end pivotally connected to the first axle 33 (see the hole 71 extended by the axle 33) and a second end with a slot 72 defined therein.

The supporting seat 8 includes a top plate 81 on which a computer keyboard, books, or other articles can be placed. The top plate 81 includes two parallel wings 82 extended downwardly from an underside thereof The wings 82 may extend laterally beyond an end of the top plate 81. Each wing 82 includes a hole 821 through which the third axle 83 is extended and an arcuate slot 822 located below the hole 821, which will be described later.

Figure 5:
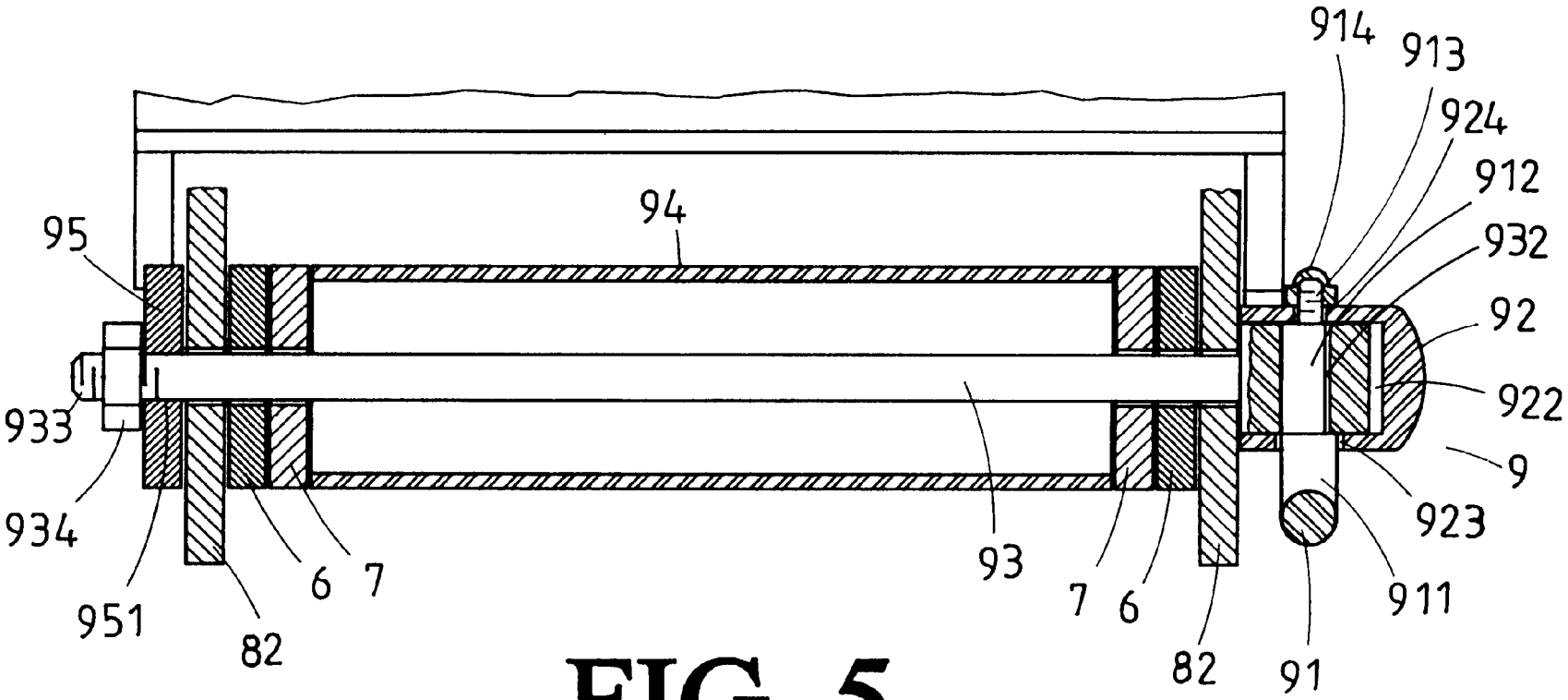
FIG. 5 is a partial sectional view illustrating a positioning device of the supporting assembly in a released status.

The positioning device 9 includes a rod 93 extended through the arcuate slots 822 of the wings 82. The rod 93 includes a first enlarged end 931 having a hole 932 defined therein and a second threaded end 933. The rod 93 is extended through the holes 62 of the linking plate and the slots 72 of the linking pieces 7. A tube 94 may be mounted around the rod 93, and a retaining washer 95 with a hole 951 and a nut 934 are mounted to the second threaded end 933 to retain the rod 93. The positioning device 9 further includes an adjusting lever arm 91 having an operative first end for manual operation and a second end 911 having an eccentric stub 912 formed thereon. In addition, a threading 913 is provided on a distal end of the eccentric stub 912. The second end 911 of the lever arm 91 is extended through the hole 932 of the rod 93, and a nut 914 is engaged with the threading 913. The positioning device 9 further includes a locking cap 92 having a protrusion 921 formed on an outer periphery thereof and received in the arcuate slot 822 of the associated wing 82. The locking cap 92 further includes a receptacle 922 defined therein for receiving the enlarged end 931 of the rod 91. The locking cap 92 has a surface 923 and further includes a transverse hole 924 through which the eccentric stub 912 of the lever arm 91 is extended, best shown in FIG. 5.

Figure 4:
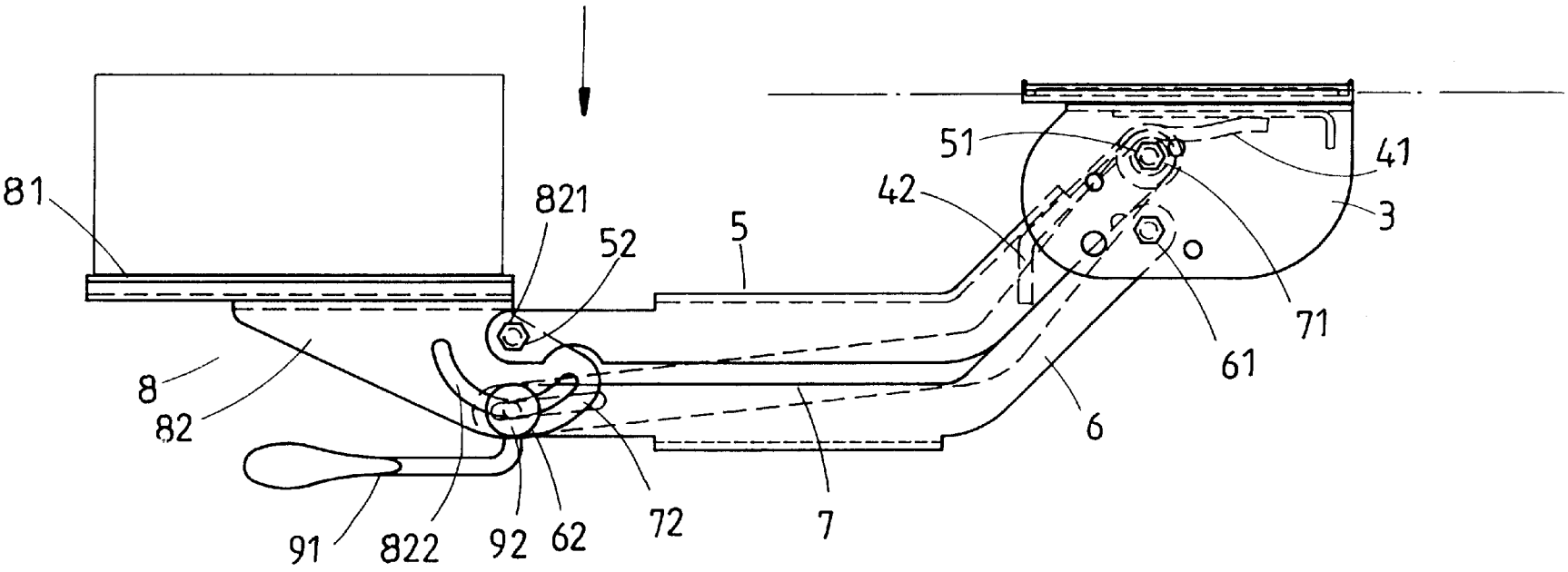
FIG. 4 is a side view similar to FIG. 3, illustrating use of the supporting assembly.

Referring to FIG. 3, the connecting plate 5, the linking plate 6, the linking pieces 7, and the supporting seat 8 are extended upwardly and outwardly under the action of the spring 4 when the supporting seat 8 is not loaded. When the supporting seat 8 is loaded, as shown in FIG. 4, the connecting plate 5 and the linking pieces 7 pivot about the first axle 33 while the linking plate 6 pivot about the second axle 34. The connecting plate 5 and the linking plate 6 assist in support of the article (not labeled) on the top plate 81.

Figure 6:
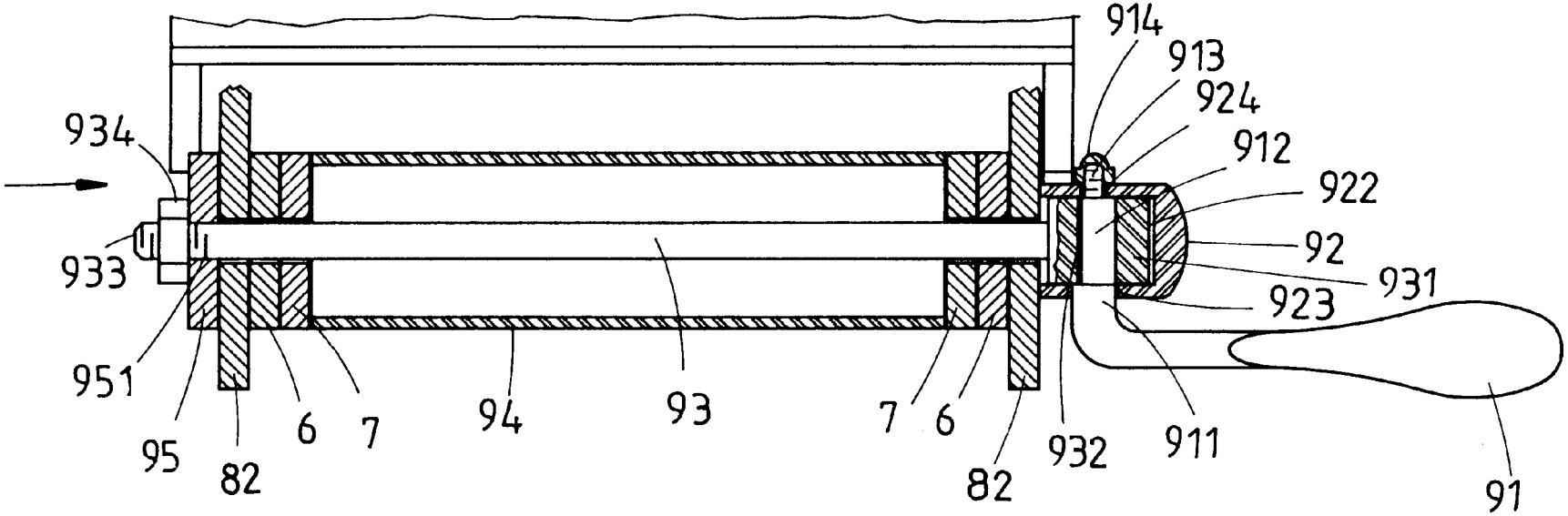
FIG. 6 is a view similar to FIG. 5, wherein the positioning device is in a locked status.

When the lever arm 91 is in a position shown in FIG. 6, the supporting seat 8 is fixed. When the lever arm 91 is in a position shown in FIG. 5, the supporting plate 8 is adjustable in the level as well as the inclination angle. Detailed operation for such adjustment is described as follows. The user may apply a force on the top plate 81 and thus retain the top plate in a substantially horizontal position shown in FIG. 4 (ignore the article on the top plate 81). Then, the lever arm 91 is pivoted to from a position shown in FIG. 6 to a position shown in FIG. 5 (see FIG. 7). The wings 82, the lining pieces 7, the linking plate 6, and the sleeve 94 have clearance therebetween to allow the rod 93 to slide along the arcuate slots 822 to a desired location. After that, the lever arm 91 is pivoted back to the position shown in FIG. 6 and thus retained in position. This is because eccentric stub 912 bears against an inner periphery of the hole 932 of the enlarged end 931 of the rod 93. As a result, the enlarged end 931 moves toward a lower portion of the receptacle 92 and thus make the eccentric stub 912, the enlarged end 931, and the locking cap 92 be in an engaged status. This also retains the lever arm 91 in place. In addition, the second end of the rod 93 may bear against the retaining washer 95 and thus retains the linking plate 6, the linking pieces 7, the wings 82, and the sleeve 94 in place. Accordingly, the top plate 81 is retained at a desired level and a desired inclination angle.

In addition, the linking pieces 7 and the linking plate 6 may be frictionally connected to the wings 32 to assist in retaining of the mounting seat 8.

Figure 8:
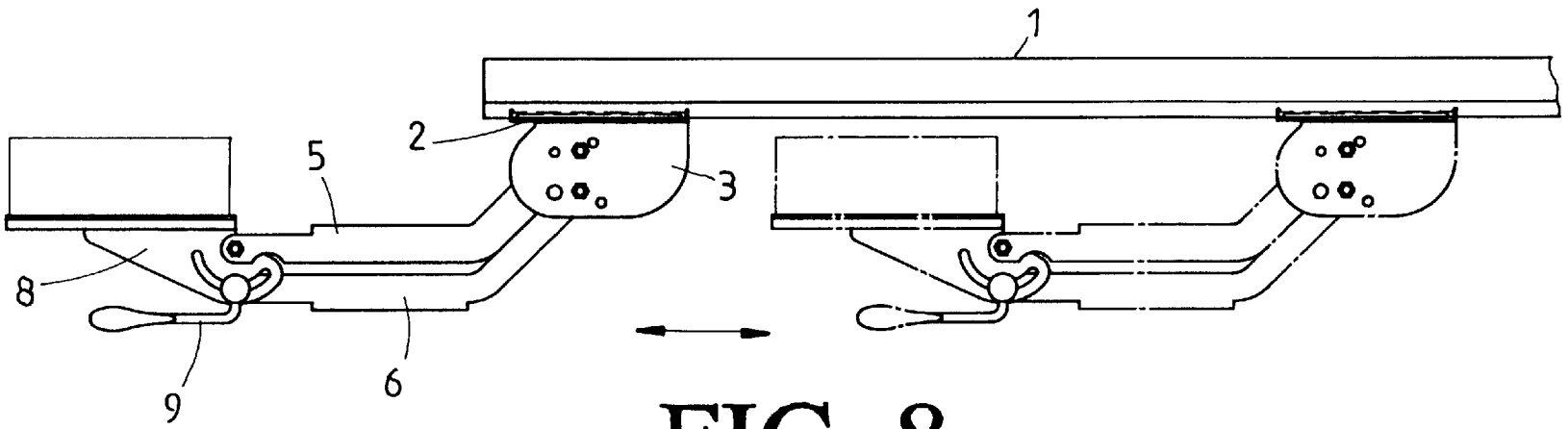
FIG. 8 and 9 are side views illustrating storage of the supporting assembly.
Figure 9:
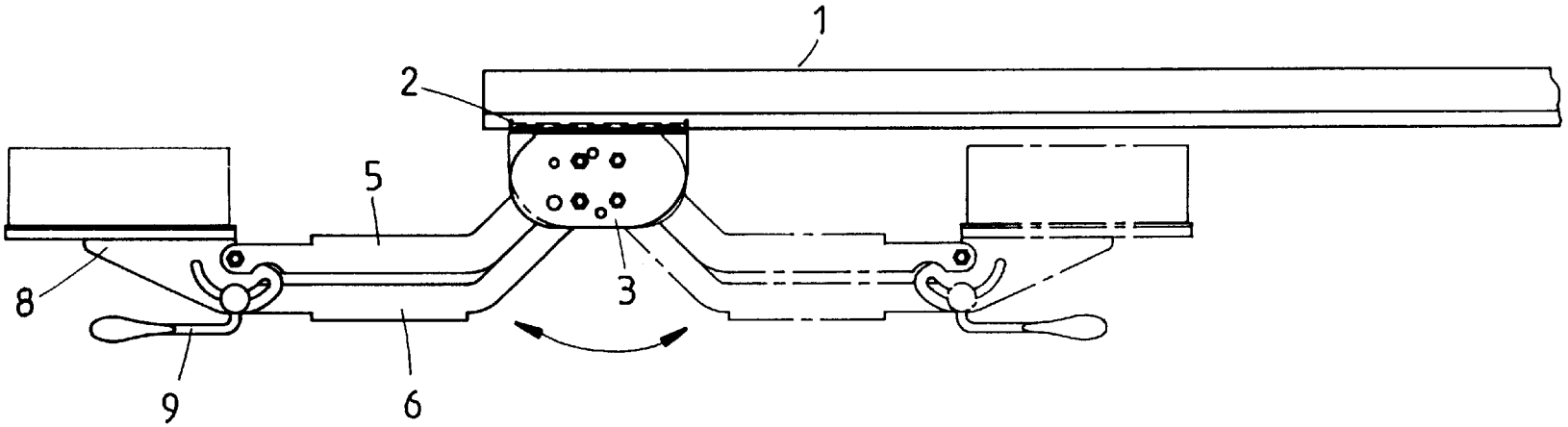

Referring to FIG. 8, when not in use, the carrier 2 may be slid inwards (rightwards in FIG. 8) to a storage position. Alternatively, the mounting seat 3 may be rotated through 180° to a storage position shown by the phantom lines.

According to the above description, it is appreciated that the level and inclination angle of the supporting seat 8 can be easily adjusted under operation of the lever arm 91. In addition, the linking pieces 7 may assist in the retaining effect. Furthermore, the mounting seat 3 and the supporting seat 8 are connected via the connecting plate 5 and the linking plate 6 to provide a stable assembly.

Although the invention has been explained in relation to its preferred embodiment, it is to be understood that many other possible modifications and variations can be made without departing from the spirit and scope of the invention as hereinafter claimed.

What is claimed is:

1. A supporting assembly comprising:

a base plate adapted to be secured to an object, a carrier slidably mounted to the base plate;

a mounting seat secured to the carrier to slide therewith yet rotatable relative to the carrier, the mounting seat including a first axle and a second axle securely mounted thereon, a spring mounted around the first axle and including a first end attached to the mounting seat and a second end, a connecting plate including a first end pivotally connected to the mounting seat and a second end, a third axle being mounted to the second end of the connecting plate, the second end of the spring being attached to the connecting plate, a linking plate having a first end pivotally connected to the second axle and a second end, at least one lining piece having a first end pivotally connected to the first axle and a second end, a supporting seat including a top plate adapted to support an article thereon, the top plate including two parallel wings extended downwardly from an underside thereof each said wing including a first hole through which the third axle is extended and an arcuate slot located below said first hole, a positioning device including:

a rod extended through the arcuate slots of the wings, the rod including a first enlarged end having a second hole defined therein and a second threaded end, the rod being extended through the second end of the linking plate and the second end of said at least one linking piece, a lever arm including an operative first end for manual operation and a second end having an eccentric stub formed thereon, the eccentric stub having a threading provided on a distal end thereof, the second end of the lever arm being extended through the second hole of the rod, and a nut being engaged with the threading, and a locking cap including a protrusion formed on an outer periphery thereof and received in the arcuate slot of the associated wing, the locking cap further including a receptacle defined therein for receiving the enlarged end of the rod, the locking cap further including a transverse hole through which the eccentric stub of the lever arm is extended, whereby when the lever arm is in a first position, the rod is retained in the arcuate slots and the top plate is retained in a level and an inclination angle relative to the mounting seat, and when the lever arm is in a second position, the rod is slidable along the arcuate slots and thus allows adjustment of the level and inclination angle of the top plate.

* * * * *